United States Patent [19]

Ikehata et al.

[11] Patent Number: 4,687,355

[45] Date of Patent: Aug. 18, 1987

[54] PRINTING HEAD FOR USE IN DOT PRINTERS

[75] Inventors: Tsutomu Ikehata, Saitama; Katsuya Masuda, Tokyo; Makoto Yasunaga, Saitama; Takao Michioto, Tokyo, all of Japan

[73] Assignee: Citizen Watch Co., Ltd., Tokyo, Japan

[21] Appl. No.: 779,644

[22] Filed: Sep. 24, 1985

[30] Foreign Application Priority Data

Sep. 25, 1984 [JP] Japan ..... 59-144698[U]

[51] Int. Cl.[4] ..... B41J 3/52

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 3,828,908 | 8/1974 | Schneider | 400/124 |
| 3,889,793 | 6/1975 | Cattaneo | 400/124 |
| 4,010,836 | 3/1977 | Bernardis | 400/124 |
| 4,155,660 | 5/1979 | Takahashi | 400/124 |
| 4,304,495 | 12/1981 | Wada | 400/124 |

FOREIGN PATENT DOCUMENTS

| | | | |
|---|---|---|---|
| 2540046 | 8/1984 | France | 400/124 |

OTHER PUBLICATIONS

*Handbook of Chemistry and Physics,* 45th Edition, The Chemical Rubber Company, 1964, p. E-3.

*Primary Examiner*—Paul T. Sewell

*Attorney, Agent, or Firm*—Lowe Price Leblanc Becker & Shur

[57] ABSTRACT

A printing head comprises a plurality of printing wires which are disposed in alignment with each other and for reciprocal motion. Each of the printing wires is formed by a main body member made of powdered high speed steel, and a chip member made of a rhenium base alloy and welded to an outer tip end of the main body member by means of partial welding. Further, a wire guide member made of zirconia is provided to guide the wire for reciprocal motion of the wire.

2 Claims, 2 Drawing Figures

PRINTING HEAD FOR USE IN DOT PRINTERS

BACKGROUND OF THE INVENTION

The present invention relates to a printing head for use in dot printers and, more particularly, to a printing wire for said printing heads.

Typically, a conventional dot printer, which is known as a sort of impact printers, comprises a plurality of printing wires disposed in alignment with each other and corresponding in number to picture elements or elemental areas forming a character pattern, and is so constructed as to perform printing of desired characters by selectively energizing such wires while the printing head is driven to move at a constant speed. Since the printing head of this kind is frequently and repetitively operated, preferably, the printing head can well withstand to break and wear. To this end, as disclosed in U.S. Pat. No. 3,828,908, Japanese Patent Publication No. 57-1428, Japanese Utility Model Publication No. 57-45170, and Japanese Provisional Patent Publication Nos. 59-111862 and 59-111863, conventional printing heads generally consist of a main body member and a chip member secured to an outer tip end of the main body member, which is composed of a high fracture or break resistant wire such as a tungsten wire, a piano wire, a maraging steel wire, etc., whereas the chip member is made of a tungsten carbide alloy having high wear resistance. In these wire constructions, since the tungsten carbide alloy constituting the chip member becomes fragile at the melting point of the high fracture resistant wire forming the main body member, these members cannot be joined by means of welding. Therefore, to positively join the main body member and the chip member of the printing wire together, with an increased joining strength at their junction, in most cases, these members are secured with each other by means of brazing. However, in the case of utilizing such brazing process for the formation of the printing wire, since the whole of the wire is subjected to heating during brazing, the main body member and the chip member change in their properties and are thus deteriorated in durability and linearity, resulting in poor assembly accuracy and poor printing quality of the wire. Moreover, after completion of brazing, it is required to scrape a solder which protrudes outside the peripheral surface of the wire to enable the resulting printing wire to fit well to an associated wire guide member of the printing head which slidably receives the wire. The necessity of scraping makes it difficult to improve the productivity of the printing wire.

SUMMARY OF THE INVENTION

It is an object of the invention to provide a printing wire having high fracture resistance, high wear resistance, and high bending strength, and a printing head for use in dot printers formed by the printing wires of this kind.

It is a further object of the invention to provide a printing wire free from property change and linearlity deterioration, and a printing head for dot printers formed by the printing wires of this kind and excellent in durability, assembly accuracy, printing quality, and productivity.

It is a still further object of the invention to provide a printing head for dot printers formed by wires materially intimate with associated wire guide members and having improved durability.

According to the present invention, there are provided a printing wire and a printing head for use in dot printers. The printing head has a plurality of the printing wires disposed in alignment with each other and driven for reciprocal motion, each wire being formed of a main body member and a chip member secured to a tip end of the main body member. The chip member is made of rhenium base alloy and is welded to the main body member made of high speed steel.

DETAILED DESCRIPTION

Figure 2:
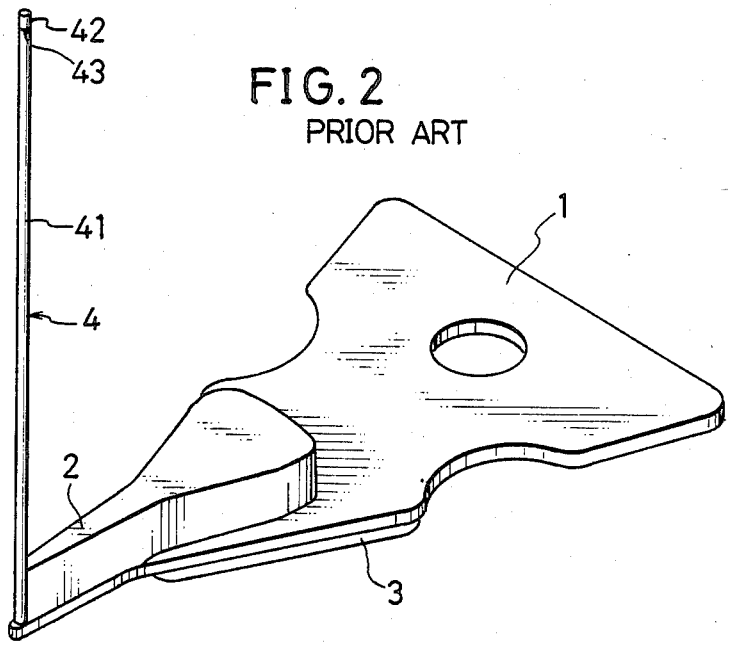
FIG. 2 PRIOR ART
FIG. 2 is a perspective view showing a leaf spring unit for use in a conventional printing head.

With reference to the accompanying drawings, an embodiment of the present invention will be now explained. In FIG. 2, which shows a conventional leaf spring unit forming part of a printing head for use in dot printers, an armature 2 of an electromagnet for driving an associated printing wire 4 is secured to one side or lower surface of the free end of a leaf spring 1 supported at its one end by a frame, not shown, while a reinforcing plate 3 is secured to the other side or upper surface of the free end portion of the plate 1. Fixed at a root end portion to an outer tip end of the armature 2 is a printing wire 4 which extends perpendicular to the armature 2, and is adapted to perform a reciprocal motion along its axis whenn a solenoid coil (not shown) of the electromagnet is energized and deenergized to momentarily produce an attractive force between the armature 2 and a core (not shown) of the electromagnet around which the solenoid coil is wound. Although an illustration will be omitted, the printing head comprises a plurality of the above-mentioned leaf spring units which correspond in number to picture elements required for the formation of a row of a character pattern, these leaf spring units being disposed along the same circumference so that the same number of the printing wires are disposed in alignment with each other.

The printing wire 4 is formed by a main body member 41 made of a high fracture (break) resisting wire such as a tungsten wire, a piano wire, and a maraging steel wire. On the other hand, a chip member 42 is made of tungsten carbide having high wear resistance, and is secured to a tip end of the main body member 41 by means of brazing. However, the conventional printing wire 4 as constructed above has the above-mentioned drawbacks due to the fact that the wire 4 is formed by the main body member 41 and the chip member 42 secured to the former member 41 by brazing using a filler metal to be filled therebetween to combine them.

Figure 1:
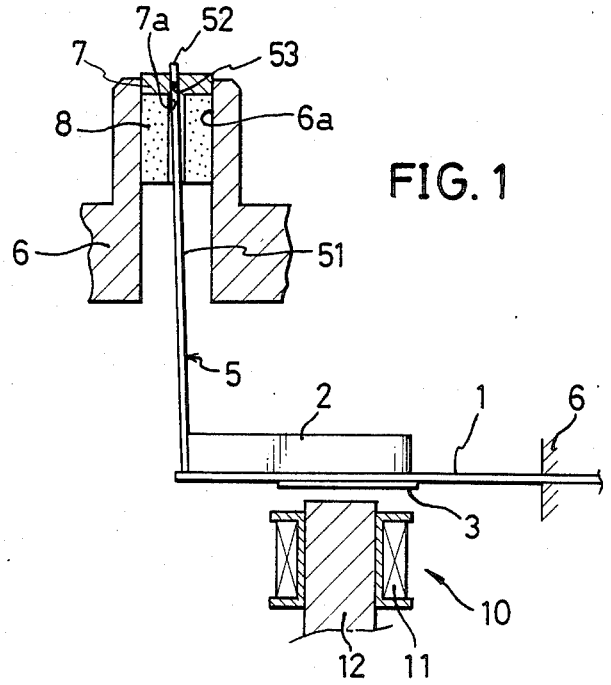
FIG. 1 is a fragmentary side view showing, partly in section, a significant portion of a printing head according to an embodiment of the present invention.

FIG. 1 shows a printing head for use in dot printers according to an embodiment of the present invention, which is basically the same in construction as that of the conventional leaf spring unit of FIG. 2. The same reference numerals are employed to show like parts common to the printing head of FIG. 1 and the unit of FIG. 2, and the explanations of the above-mentioned parts will be partly omitted.

In FIG. 1, reference numeral 6 designates a frame which supports the fixed end of the leaf spring 1 and is formed at its outer wall with a through hole 6*a*. A wire guide member 7 made of zirconia is fitted ino an outer opening end of the through hole 6*a*, and preferably, a felt member 8 adapted to contain oil is disposed adjacent a bottom side surface of the wire guide member 7. Reference numeral 5 designates a printing wire which corresponds to the printing wire 4 of FIG. 2. The wire 5 comprises an elongated rod-like main body member 51 having its root end portion secured to the armature 2 of the electromagnet for driving the wire 5, and its outer end or junction 53 to which a rod-like chip member 52 having substantially the same outer diameter as that of the main body member 51 is secured. The main body member 51 is made of powder processed high speed steel having high fracture resistance. For instance, this steel consists of 1.28 percent by weight carbon, 4.15 percent by weight chromium, 5.00 percent by weight molybdenum, 6.40 percent by weight tungsten, 3.10 percent by weight vanadium, 8.00 percent by weight cobalt, and the balance iron and inevitable impurities. Typically, this steel has a fracture strength of 450 kilograms per square milimeter. On the other hand, the tip member 52 is made of a rhenium base alloy having high wear resistance, such as an alloy of rhenium, ruthenium, and tantalum, having its typical wear resistance on the order of 0.01 millimeters per 100 million times of reciprocal motion. Further, these members 51, 52 are welded by means of electric resistance welding, for instance. The powdered high speed steel has its melting point falling within a range of 1600–1800 degrees C., while the rhenium base alloy has its melting point falling within a range of 2300–2400 degrees C. Therefore, the rhenium base alloy cannot be deformed even when it is heated up to the melting point of the main body member, i.e., up to 1800 degrees C., and thus the members 51, 52 can be welded without difficulty.

Further, the wire 5 has its outer end portion slidably received in a central guide hole 7*a* formed in the wire guide member 7, and is brought into contact with an inner peripheral surface of a central hole 7*a* formed in the felt member 8 and obliquely extending with respect to the axis of the wire 5, when the wire 5 slides along the guide member 7. Preferably, the wire guide member 7 is made of zirconia, which is well intimate with the rhenium base alloy constituting the chip member 42. Reference numeral 10 designates the above-mentioned electromagnet for driving the leaf spring 1. This eletromagnet 10 has a coil 11 wound around a core 12, and is secured to the frame 6.

In manufacturing the printing wire 5, the materials forming the respective members 51, 52 can be directly welded to provide a sufficient strength at their junction, without the need of securing them by brazing, as opposed to the conventional wire construction. Preferably, these members 51, 52 are welded by performing local or partial welding such as electric resistance welding and laser welding for a short period of time. As is known, in electric resistance welding, for instance, the main body member 51 and the chip member 52 are disposed in abutment to each other, and then an electric current flowing through the junction 53 therebetween is supplied to weld these members at their juction 53. According to local welding of these types merely effected for a short period of time, only the junction 53 and portions in the vicinity thereof are subjected to momentary heating, and thus no significant change in property of the main body member 51 nor deterioration in linearity thereof occur.

The dot printer formed by the above-mentioned printing head operates as follows:

To print desired characters, as in conventional printing heads, electromagnets are selectively and repetitively energized to reciprocate associated printing wires to hit only required portions of an ink ribon at a time against a paper, not shown, while the printing head is driven to incrementally move along the direction of printing.

Although the printing head is required to repetitively perform the operation mentioned above, the printing wire 5 can positively work for a long time without fracture because of the increased joining strength of the junction 53 between the main body member 51 and the chip member 52 which are directly welded to each other, as well as the specific construction of the main body member 51 made of the powdered high speed steel having high fracture resistance. Furthermore, since the chip member 52 has its high wear resistance and the main body member 51 is free from a property change and has a good linearity, the printing head can withstand to heavy and long use, and keeps its good printing quality for a long time. During the printing operation, the chip member 52 made of the rhenium base alloy smoothly slides along the wire guide member 7 made of zirconia which is intimate with the former member 52. Thus, the chip member 52 can highly withstand to break off and wear as compared to conventional one employed together with the most excellent conventional printing wire guide made of ruby. Further, the wire guide member 7 is well lubricated by the oil contained in the felt member 8 to achieve a smooth sliding movement of the wire 5.

What is claimed is:

1. A printing head for use in dot printers having a plurality of printing wires disposed in alignment with each other and selectively driven for reciprocal motion to perform printing, comprising:

printing wires each formed by main body members made of high speed steel, and chip members made of a Re-Ru-Ta alloy and welded to respective outer tip ends of said main body members;

a wire guide member formed with a hole therein for respectively contacting and guiding said outer ends of printing wires for reciprocal motion of said wires, said wire guide member being made of zirconia;

wherein said printing head further includeds a felt member containing an oil, said felt member being disposed inwardly of said wire guide member, said printing wires respectively being brought into direct contact with said felt member during reciprocal motion of said printing wires; and further including leaf springs each supporting a corresponding one of said main body members; and a frame supporting said leaf springs, said frame having an outer wall formed therein with a through hole;

wherein said wire guide member has an inner end face, a corresponding said felt member being fitted into the through hole formed in said frame and disposed at a location adjacent the inner end face of said wire guide member, said felt member being formed therein with a central hole slidably receiving said printing wires.

2. A printing head as claimed in claim 1, wherein said high speed steel consists of powder processed high speed steel.

* * * * *